US011780667B2

(12) United States Patent
Turner et al.

(10) Patent No.: US 11,780,667 B2
(45) Date of Patent: Oct. 10, 2023

(54) PISTON FOR A COLLAPSIBLE CARTRIDGE

(71) Applicant: Sulzer Mixpac AG, Haag (CH)

(72) Inventors: Hayden Turner, Ayer, MA (US); Evan Travers, Groveland, MA (US)

(73) Assignee: MEDMIX SWITZERLAND AG, Haag (CH)

( * ) Notice: Subject to any disclaimer, the term of this patent is extended or adjusted under 35 U.S.C. 154(b) by 0 days.

(21) Appl. No.: 17/730,686

(22) Filed: Apr. 27, 2022

(65) Prior Publication Data

US 2022/0411169 A1 Dec. 29, 2022

Related U.S. Application Data

(63) Continuation of application No. 16/956,821, filed as application No. PCT/EP2018/086391 on Dec. 20,
(Continued)

(51) Int. Cl.
*B65D 83/00* (2006.01)
*B05C 17/005* (2006.01)
(Continued)

(52) U.S. Cl.
CPC .... *B65D 83/0005* (2013.01); *B05C 17/00553* (2013.01); *B05C 17/00579* (2013.01);
(Continued)

(58) Field of Classification Search
CPC . B65D 83/005; B05C 17/01; B05C 17/00553; B05C 17/00576
See application file for complete search history.

(56) References Cited

U.S. PATENT DOCUMENTS 2,361,647 A 10/1944 Robert
3,323,682 A 6/1967 Creighton, Jr. et al.
(Continued)

FOREIGN PATENT DOCUMENTS

CN 101746570 A 6/2010
CN 102066237 A 5/2011
(Continued)

OTHER PUBLICATIONS

International Search Report dated Apr. 25, 2019 in corresponding International Patent Application No. PCT/EP2018/086391, filed Dec. 20, 2018.
(Continued)

*Primary Examiner* — Reinaldo Sanchez-Medina
(74) *Attorney, Agent, or Firm* — GLOBAL IP COUNSELORS, LLP

(57) ABSTRACT

A piston for a collapsible cartridge for dispensing a material, the piston includes a rigid portion and a flexible portion. The rigid portion has a first diameter, a first end and a second end. The first end is configured to be disposed in a material dispensing direction. The flexible portion has a second diameter less than the first diameter, a first end disposed in the material dispensing direction and a second end disposed in an opposite direction. The flexible portion is disposed on the first end of the rigid portion such that the second end of the flexible portion is disposed to face the first end of the rigid portion. The flexible portion is configured to radially expand and longitudinally compress upon a force applied to the first end of the flexible portion to compress the collapsible cartridge between the flexible portion and an interior surface of a support cartridge.

26 Claims, 7 Drawing Sheets

Related U.S. Application Data

2018, now Pat. No. 11,414,260, which is a continuation of application No. 15/855,357, filed on Dec. 27, 2017, now Pat. No. 10,968,031.

(51) Int. Cl.
*B05C 17/015* (2006.01)
*B65D 81/32* (2006.01)

(52) U.S. Cl.
CPC ..... *B05C 17/00583* (2013.01); *B05C 17/015* (2013.01); *B65D 83/005* (2013.01); *B65D 81/325* (2013.01); *B65D 83/0072* (2013.01)

(56) References Cited

U.S. PATENT DOCUMENTS

| | | | |
|---|---|---|---|
| 4,312,344 | A | 1/1982 | Nilson |
| 4,411,656 | A | 10/1983 | Cornett, III |
| 4,877,156 | A | 10/1989 | Clanet |
| 4,907,727 | A | 3/1990 | Ernst et al. |
| 5,386,928 | A | 2/1995 | Blette |
| 5,447,110 | A | 9/1995 | Brown |
| 5,566,860 | A | 10/1996 | Schiltz et al. |
| 5,647,510 | A | 7/1997 | Keller |
| 5,964,416 | A | 10/1999 | Jaeger et al. |
| 6,004,300 | A | 12/1999 | Butcher et al. |
| 6,070,763 | A | 6/2000 | Gueret |
| 6,223,941 | B1 | 5/2001 | Nealey |
| 6,286,725 | B1 | 9/2001 | Gerber |
| 6,322,542 | B1 | 11/2001 | Nilson et al. |
| 6,435,373 | B1 | 8/2002 | Mizrahi |
| 6,578,738 | B1 | 6/2003 | Keller |
| 6,620,134 | B1 | 9/2003 | Trombley et al. |
| 6,796,463 | B2 | 9/2004 | Boal, Jr. |
| 7,226,231 | B2 | 6/2007 | Py et al. |
| 8,544,683 | B2 | 10/2013 | Springhorn et al. |
| 8,631,970 | B2 | 1/2014 | Chan et al. |
| 8,678,246 | B2 | 3/2014 | Reuter |
| 8,763,829 | B2 | 7/2014 | Madaus |
| 8,895,390 | B2 | 11/2014 | Pramanik |
| 8,925,764 | B2 | 1/2015 | Hiemer |
| 9,144,821 | B2 | 9/2015 | Obrist |
| 9,155,679 | B2 | 10/2015 | Imai |
| 9,481,495 | B2 | 11/2016 | Bellmore |
| 10,968,031 | B2 | 4/2021 | Turner |
| 2008/0011784 | A1 | 1/2008 | Schneider et al. |
| 2008/0023495 | A1 | 1/2008 | Takayama et al. |
| 2008/0054020 | A1 | 3/2008 | Pierson et al. |
| 2012/0247323 | A1 | 10/2012 | Obrist |
| 2013/0020276 | A1 | 1/2013 | Madaus |
| 2013/0277364 | A1 | 10/2013 | Kusuma et al. |
| 2013/0306671 | A1 | 11/2013 | Herman et al. |
| 2014/0208939 | A1 | 7/2014 | Frey |
| 2014/0214010 | A1 | 7/2014 | Kuo et al. |
| 2015/0076171 | A1 | 3/2015 | Herman et al. |
| 2016/0288159 | A1 | 10/2016 | Seifer |
| 2017/0144188 | A1 | 5/2017 | Burns |
| 2017/0259296 | A1 | 9/2017 | Obrist |
| 2017/0326580 | A1 | 11/2017 | Chen et al. |

FOREIGN PATENT DOCUMENTS

| | | | |
|---|---|---|---|
| CN | 102556516 | A | 7/2012 |
| CN | 103998148 | A | 8/2014 |
| CN | 103998149 | A | 8/2014 |
| CN | 104590759 | A | 5/2015 |
| CN | 104648766 | A | 5/2015 |
| CN | 106458424 | A | 2/2017 |
| CN | 107073510 | A | 8/2017 |
| DE | 10 2011 010 763 | A1 | 8/2012 |
| DE | 20 2015 1 04 599 | U1 | 11/2015 |
| EP | 0150894 | B1 | 5/1988 |
| EP | 0144925 | B1 | 3/1989 |
| EP | 2998030 | A1 | 3/2016 |

OTHER PUBLICATIONS

Chinese Office Action and Search Report dated Jul. 5, 2021 in corresponding Chinese Patent Application No. 201880090387 (with English Translation).

Chinese Office Action dated Dec. 28, 2021 in corresponding Chinese Patent Application No. 201880090387 (with English Translation).

PISTON FOR A COLLAPSIBLE CARTRIDGE

CROSS REFERENCE TO RELATED APPLICATION

This application is a divisional of U.S. application Ser. No. 16/956,821, filed Jun. 22, 2020, which is a U.S. National Stage application of International Application No. PCT/EP2018/086391, filed Dec. 20, 2018, which claims priority to U.S. patent application Ser. No. 15/855,357, filed Dec. 27, 2017, now U.S. Pat. No. 10,968,031, issued Apr. 6, 2021, the contents of each of which are incorporated herein by reference.

BACKGROUND

Field of the Invention

The invention relates to piston for a collapsible cartridge. In particular, the invention relates to piston for a collapsible cartridge that reduces waste and air volume in the cartridge.

Background of the Invention

In the construction and dental sectors, cartridges are frequently used to dispense liquids, for example, sealing components, components for chemical dowels or chemical anchors, adhesives, pastes or impression materials in the dental sector.

Conventional dispensers can be single-component systems in which the material to be dispensed is formed from one component and two-component or multicomponent systems in which at least two different components are stored in separate chambers of the same cartridge or in separate cartridges. The two-component or multicomponent systems, the components are mixed by a dynamic or static mixing apparatus. Examples of multicomponent systems include adhesives or chemical dowels which only harden after the mixing of the two components. Two-component systems can also be used in the industrial sector for paints which are often used to generate functional protective layers such as for corrosion protection.

Many conventional systems can include prefilled cartridges designed for a single use. In such systems a substantial amount of waste results both with regard to volume and to mass. An alternative to these cartridges are unfilled cartridges that can be transported by the cartridge manufacturers to the manufacturers of the filling materials who then fill the empty cartridges. Even though the unfilled cartridges have a relatively low weight, the costs for the transport of the empty cartridges from the cartridge manufacturers to the media manufacturers are relatively high since the empty cartridges have a relatively large volume and thus high space requirements on transport. The storage costs for the empty cartridges both at the cartridge manufacturers' and at the media manufacturers' are furthermore also relatively high due to the space requirements. These costs make up a not insubstantial portion of the total manufacturing costs of the cartridges.

SUMMARY

It has been discovered that providing a system and method to improve the collapsing of the cartridge would be advantageous. In particular, it has been determined that an improvement in collapsing the cartridge can reduce the space need for storing and shipping purposes and reduces the waste of a component filing the cartridges.

In view of the state of the known technology, one aspect of the present disclosure is to provide a piston for a collapsible cartridge for dispensing a material, the piston comprising a rigid portion and a flexible portion. The rigid portion has a first diameter, a first end and a second end. The first end is configured to be disposed in a material dispensing direction. The flexible portion has a second diameter less than the first diameter, a first end disposed in the material dispensing direction and a second end disposed in an opposite direction. The flexible portion is disposed on the first end of the rigid portion such that the second end of the flexible portion is disposed to face the first end of the rigid portion. The flexible portion is configured to radially expand and longitudinally compress upon a force applied to the first end of the flexible portion so as to compress the collapsible cartridge between the flexible portion and an interior surface of a support cartridge.

Another aspect of the present disclosure is to provide a dispensing system, comprising a cartridge and a piston. The cartridge has a head part and a cartridge wall which define a reception chamber configured to retain a medium to be dispensed. The head part includes a surface and an outlet in the surface. The outlet is configured to enable the material to be dispensed therethrough. The cartridge wall is configured to be collapsible. The piston is configured to collapse the cartridge and dispense the medium. The piston includes a rigid portion having a first diameter, a first end and a second end, the first end configured to be disposed in a material dispensing direction, and a flexible portion having a second diameter less than the first diameter, a first end disposed in the material dispensing direction and the second end disposed in an opposite direction. The flexible portion is disposed on the first end of the rigid portion such that the second end of the flexible portion is disposed to face the first end of the rigid portion, and the flexible portion is configured to radially expand between about 1 mm and 3 mm upon a force being applied to the piston in the material dispensing direction such that the first end of the flexible portion contacts the surface of the head part.

Another aspect of the present disclosure is to provide a method of filling a material into a cartridge, the method comprising collapsing the cartridge with a piston, the piston having a rigid portion and a flexible portion, the flexible portion being disposed at the dispensing end of the piston, applying a force to the piston such that the flexible portion of the piston contacts a surface of a head part of the cartridge, causing a diameter of the flexible portion to radially increase, compressing the cartridge between a radial surface of the flexible portion and am interior surface a cartridge support, and adding the material through an opening in the head part, causing the piston to move in a direction away from the head part.

BRIEF DESCRIPTION OF THE DRAWINGS

Referring now to the attached drawings which form a part of this original disclosure.

DETAILED DESCRIPTION OF THE EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
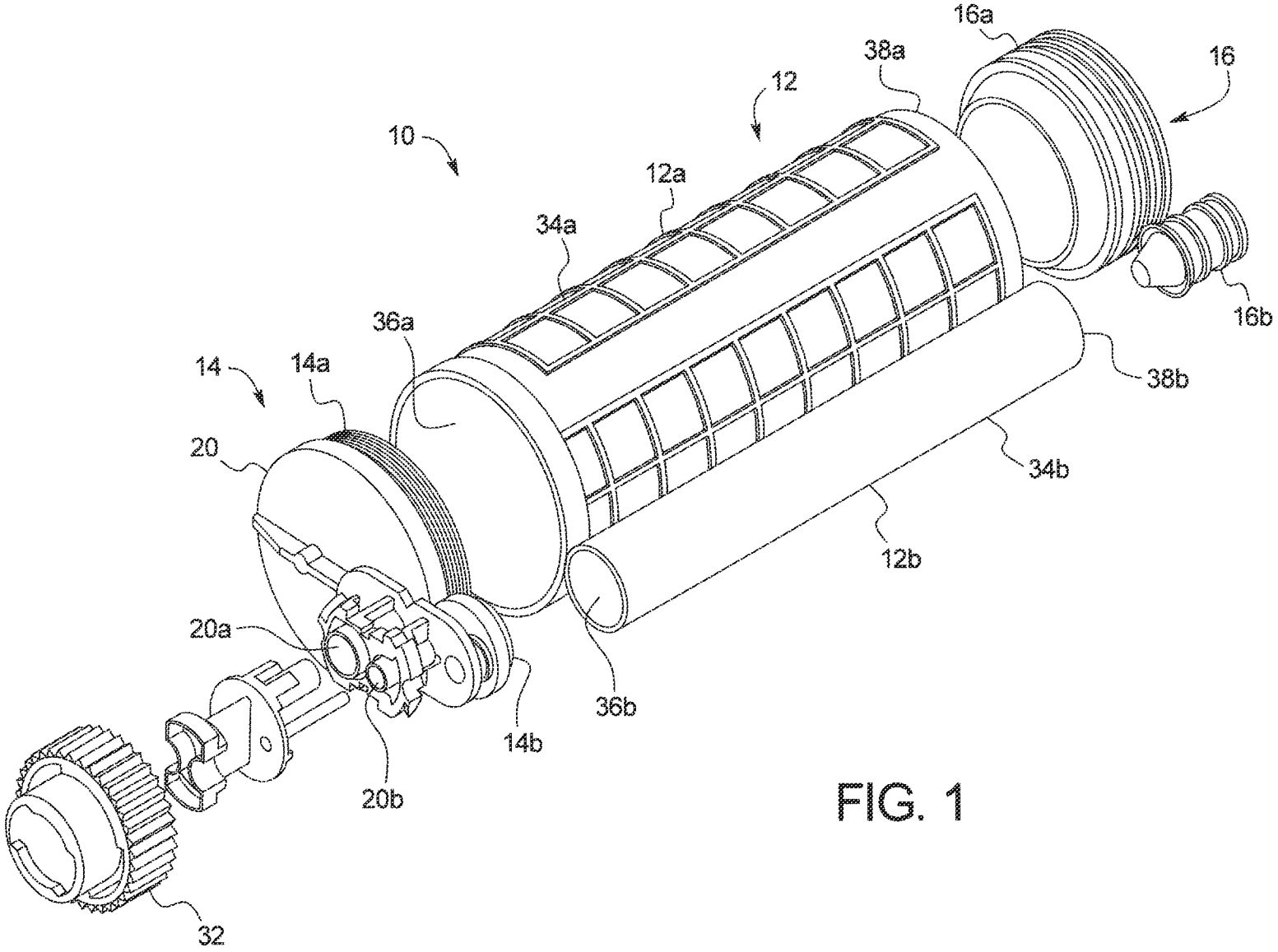
FIG. 1 illustrates an exploded perspective view of a piston according to a first embodiment of the present invention in combination with a support cartridge.
Figure 2:
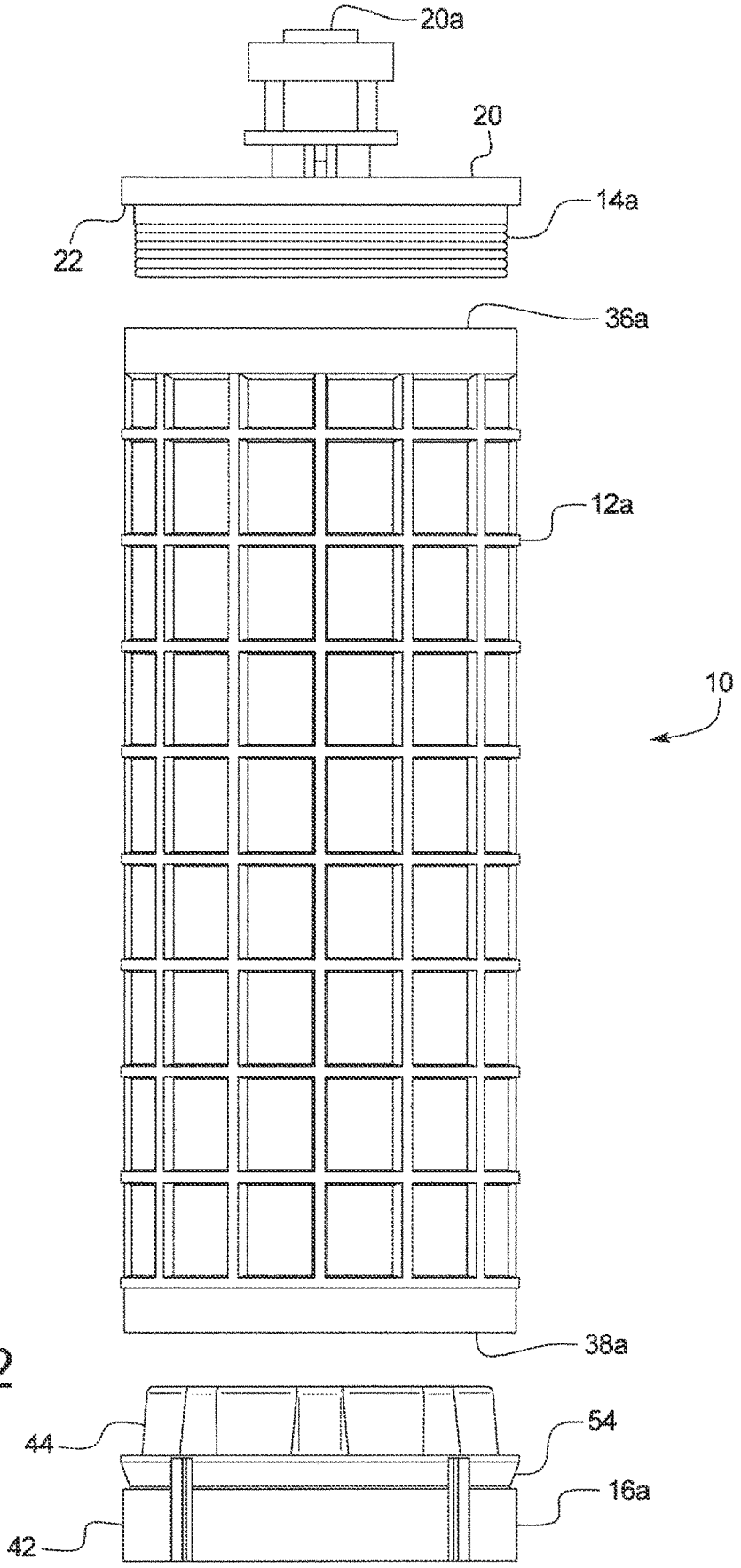
FIG. 2 is an exploded side elevational view of the support cartridge of FIG. 1.

Referring initially to FIGS. 1 and 2, a dispensing system 10 according to an embodiment of the present invention is illustrated. The dispensing system 10 includes a support cartridge system 12, a two-component collapsible cartridge 14 and piston system 16. As can be understood, the dispensing system 10, when filled with a component, can be inserted into a dispensing device to dispense the component or components, as is known in the art.

As is understood, a dispensing system 10 for two-components, as described herein, is configured to hold, store and dispense two separate components. The two components can be mixed upon dispensing or at any suitable time. Such a two-component dispensing system enables materials or components that would otherwise be stored for a significant time period to be stored and used at a later time. It is noted that the piston and dispensing system 10 described herein can be used in a single component dispensing system, a two-component dispensing system or a multicomponent (more than two) system, if desired.

Figure 3:
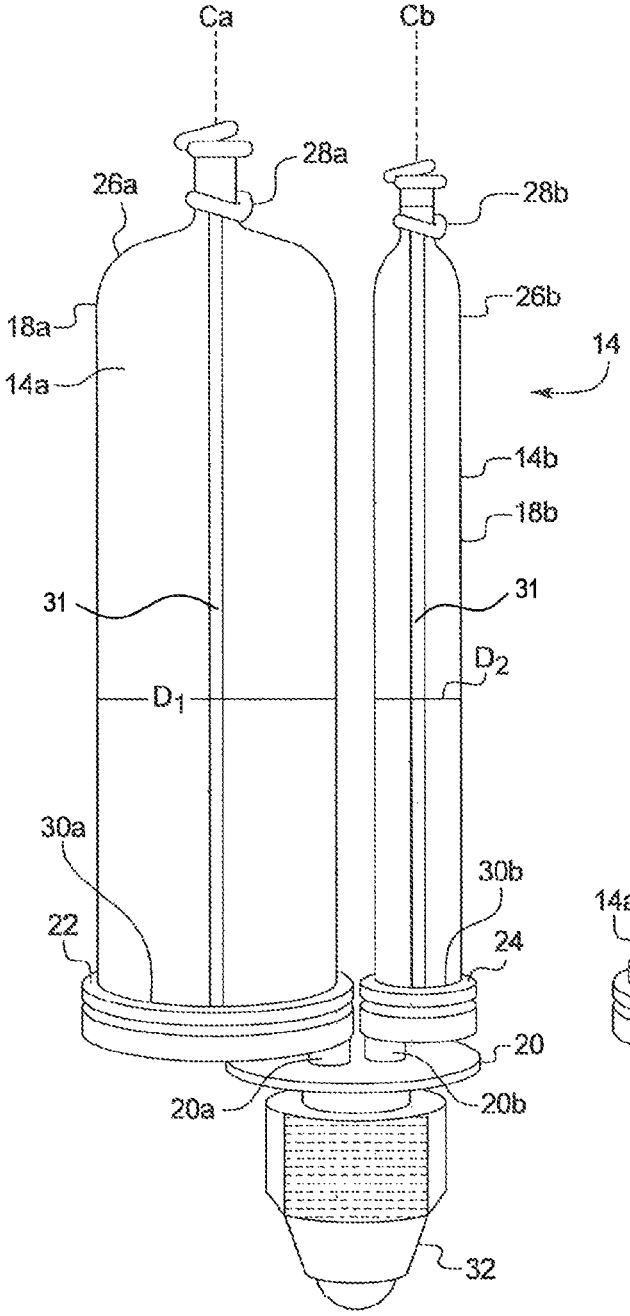
FIG. 3 is a side view of two-component cartridge of FIG. 1 is an expanded state.

Turning to FIG. 3, a two-component collapsible cartridge 14 is illustrated. The cartridge includes a first generally cylindrical reception chamber (or cartridge) 14*a* and a second generally cylindrical reception chamber (or cartridge) 14*b*. The reception chambers 14*a* and 14*b* are each defined by a cartridge wall 18*a* and 18*b* and a common head part 20. The common head part 20 preferably forms an end-face or surface 22 and 24 of each of the reception chambers 14*a* and 14*b*. The ends 26*a* and 26*b* of the two cartridge walls 18*a* and 18*b* are disposed remote from the head part 20 and are each led together toward the center axis $C_a$ and $C_b$ of the respective reception chamber 18*a* and 18*b* and can be bound together by a respective clamping ring 28*a* and 28*b*, or in any other suitable manner, such that the ends are capable of being sealingly closed.

As shown in FIG. 3, the first reception chamber 14*a* has a diameter $D_1$ that is larger than the diameter $D_2$ of the second reception chamber 14*b*; however, the reception chambers 14*a* and 14*b* can have the same or substantially the same diameter, or have any diameter desired. That is, the diameters can have any relative size to each other that would enable two separate components or materials to be mixed together in a suitable or desired ratio.

The ends 30*a* and 30*b* of the reception chambers 14*a* and 14*b* facing the head part 20 are sealingly and unreleasably connected to the head part 20. In one embodiment, the head part 20 is injection molded to the ends of the reception chambers 14*a* and 14*b*. The head part 20 can be formed from a stable-shape plastic, and the cartridge walls 18*a* and 18*b* can be formed as multilayer films which are each rolled to a cylindrical shape in their predominantly center regions and are welded or otherwise connected to form a seam 31 at their longitudinal edges thus forming together with the head part 20 the cylindrical reception chambers 18*a* and 18*b*.

The head part 20 preferably includes two outlets 20*a* and 20*b* which are connected to the reception chambers 18*a* and 18*b* for filling the reception chambers with a filling component or material and for dispensing the filling component or material out of the reception chambers. A screw cap 32 can be used to close the outlets.

As can be understood, FIG. 3 illustrates the reception chambers 14*a* and 14*b* in an empty state. In other words, the reception chambers 14*a* and 14*b*, as shown in FIG. 3 have not yet filled with a component, i.e. with the material to be dispensed. However, as shown in this embodiment, the cartridge walls 18*a* and 18*b* have a substantially cylindrical shape due to the stiffness of the used film material. It is noted that this cylindrical shape represents the expanded state of the reception chambers 14*a* and 14*b* with a maximum volume of the reception chambers.

Figure 4:
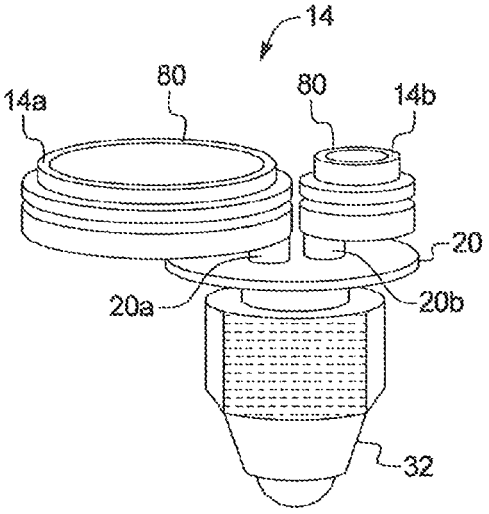
FIG. 4 is a side view of the two-component cartridge of FIG. 1 is a compressed state.

As shown in FIG. 4, the cartridge walls 18*a* and 18*b* can pushed together or compressed in the longitudinal direction of the reception chambers 14*a* and 14*b* before filling with the component. When the collapsed state is accomplished as described herein, this state has been determined to reduce the space need for storing and shipping purposes and reduces the waste of a component filing the reception chambers 14*a* and 14*b*.

Turning back to FIGS. 1 and 2, the support cartridge system 12, includes first and second support cartridges 12*a* and 12*b* that include first and second hollow cylinders 34*a* and 34*b*, respectively. The first and second hollow cylinders 34*a* and 34*b* are sized and configured to receive the first and second reception chambers 14*a* and 14*b* and of the two-component collapsible cartridge 14, respectively. The first and second hollow cylinders 34*a* and 34*b* each have a first opening 36*a* and 36*b* and a second opening 38*a* and 38*b*. The first openings 36*a* and 36*b* are configured to receive a respective reception chamber 14*a* and 14*b* and the second opposite openings 38*a* and 38*b* are configured to receive a respective piston 16*a* and 16*b*. As will be described herein, the first and second reception chambers 14*a* and 14*b* and can be pushed into a respective reception opening 36*a* and 36*b* until the head part 20 contacts the end of the respective support cartridge 12*a* and 12*b*.

Figure 5:
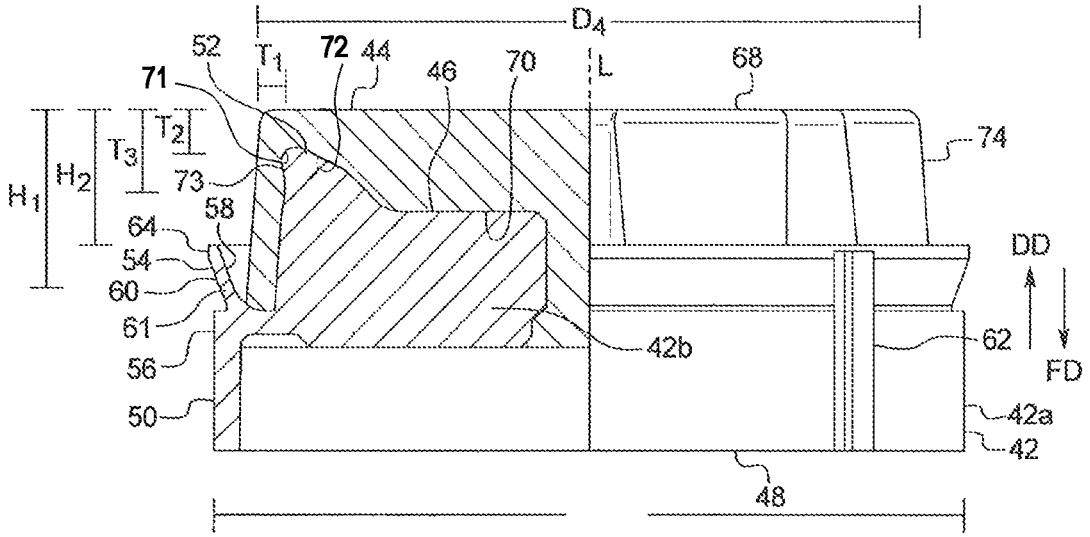
FIG. 5 illustrates a partial side elevational view of the piston of FIG. 1.
Figure 6:
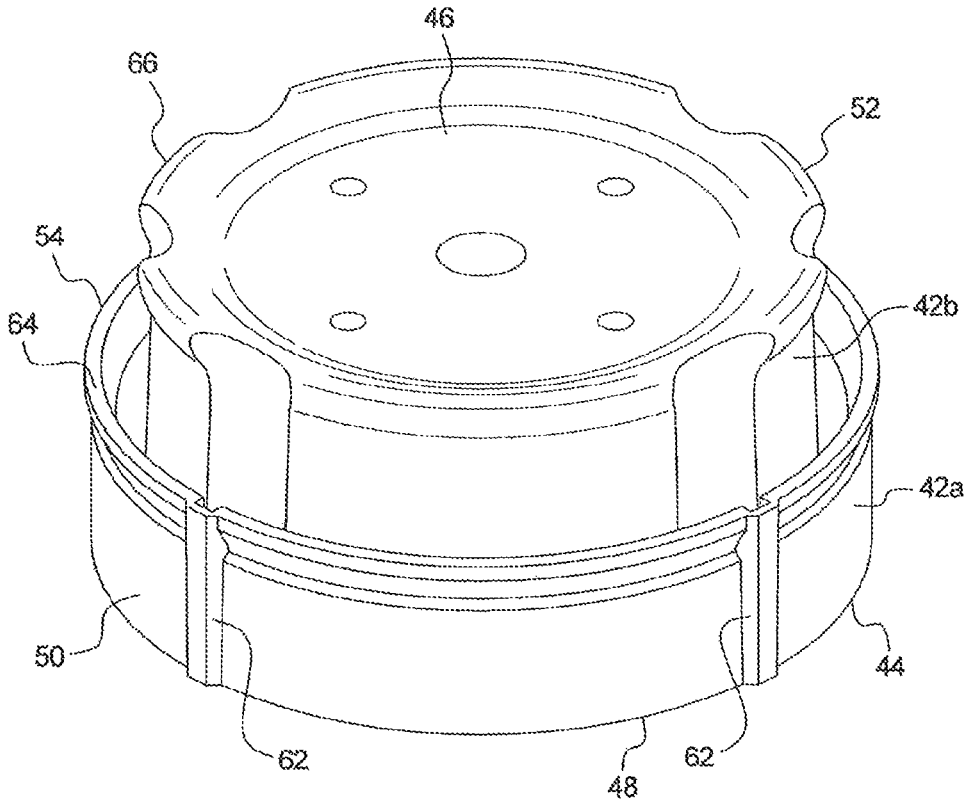
FIG. 6 is a top perspective view of the piston of FIG. 5 with the flexible portion removed.

The piston system 16 includes first and second pistons 16*a* and 16*b*, which generally have the same configuration, with the main difference being size or relative diameter. Thus, only the first piston 16*a* will be described in detail in view of FIGS. 5 and 6. FIGS. 5 and 6 illustrate a first embodiment of the present invention. The piston 16*a* is preferably generally cylindrical, and sized and configured to tightly fit within the inner peripheral surface 40 of the support cartridge 12*a*. It is noted that in this embodiment, the piston 16*a* does not need to form a seal with the support cartridge 12*a*. However, the piston 16*a* preferably forms a tight fit with the support cartridge 12*a* to prevent the reception chamber 14*a* from being pinched between the support cartridge 12*a* and the piston 16*a*.

The piston 16*a* has a first portion 42 and a second portion 44. Preferably, the first portion 42 is a rigid portion having a first diameter $D_3$, a first end 46 and a second end 48. The first end 46 of the rigid portion is disposed in the material dispensing direction DD (i.e., the direction in which the component is dispensed), and the second end 48 is disposed in the opposite direction (filling direction FD). The second end 48 of the rigid portion 42 can receive the pressure or force that is required to move the piston through the support cartridge 12*a*. The rigid portion 42 is preferably formed from any suitable plastic or metal that is rigid and does not flex under pressure. However, the rigid portion 42 can be formed from any suitable material.

As shown in FIG. 6, the rigid portion 42 includes a first rigid portion 42*a* and a second rigid portion 42*b*. The first rigid portion 42*a* is disposed externally of the second portion 44, and the second rigid portion 42*b* is disposed within the second portion 44. The first rigid portion 42*a* includes a radial outer surface 50 adjacent the second end 48 and the second rigid portion 42*b* includes a protrusion 52 adjacent the first end 46. The radial outer surface 50 includes a skirt 54 or sealing lip extending therefrom in the dispensing direction. The skirt 54 preferably extends around the entire circumference of the first rigid portion 42*a*, but can extend in any suitable or desired manner. The skirt 54 preferably extends radially outwardly from the end 56 of the radial outer surface 50 and has a diameter about the same size as the inner diameter of the support cartridge 12*a*. Accordingly, the skirt 54 is sized and configured to slide within the inner surface of the support cartridge 12*a*. In this connection, it should be noted that the skirt 54 is configured to fit within the support cartridge 12*a* in such a way that it does not tilt relative to the dispensing direction DD but also does not seal against the inner surface so that the piston 16*a* can move within the support cartridge 12*a*. In one embodiment, a hole 61 or a plurality of holes can be disposed in the skirt 54 or the rigid body 42 to enable air to pass in a direction opposite to the dispensing direction DD during dispensing. It is to be understood that the hole 61 may also be used to allow air to pass in the dispensing direction DD during filling of the respective reception chambers 14*a* and 14*b*, i.e. the air is allowed to pass in a direction opposite to the filling direction FD. Such a structure prevents air from being trapped between the piston 16*a* and the reception chamber 14*a*, while allowing a tight fit between the skirt 54 and the inner peripheral surface 40 of the support cartridge 12*a*. Moreover, the skirt 54 preferably extends in the material dispensing direction so to be capable of fitting a portion of or the entire cartridge wall 18*a* (in the collapsed state) between an inner surface 58 thereof and the second portion 42 (See FIG. 8).

In one embodiment, the radial outer surface 50 of the first rigid portion 42*a* and the outer surface 60 of the skirt 54 also includes a plurality of integrated ribs or tabs 62 spaced radial therearound. The tabs 62 generally protrude from the radial outer surface 50 of the rigid portion 42 and the outer surface 60 of the skirt 54 and extend in a longitudinal direction of the dispensing direction DD. In one embodiment, the radial outer surface 50 and the outer surface 60 of the skirt 54 includes four tabs 62 evenly spaced therearound; however, it is noted that there can be any suitable number of tabs 62, and the tabs 62 can be spaced in any suitable manner. As shown in FIG. 6, the tabs 62 can be rectangular in shape and can extend from the second end 48 of the rigid portion 42 to the end 64 of the skirt 54. The tabs 62 prevent the cartridge wall 18*a*, when being compressed, to pass over the end 64 of the skirt 54 of the piston 16*a*. When the cartridge wall 18*a* passes over the end 64 of the skirt 54, portions of the cartridge wall 18*a* can be pinched and broken between the piston 16*a* and the support cartridge 12*a*. If the cartridge wall 18*a* is compromised in this manner, a new flow path for the component or material can be formed, creating an undesirable ballooning effect behind the piston 16*a*.

The protrusion 52 is preferably cylindrical and has a diameter that is less than the diameter of the end 64 of the skirt 54. The protrusion 52 can include an arcuate edge 66 that extends from the edge formed by the first end 46 and the upper radial surface 68 of the second rigid portion 42*b*. This protrusion 52 increases the support at the edge 66 and guides the cartridge wall 18*a* to allow the cartridge wall 18*a* to fit the piston geometry, furthering the amount of material to be dispensed out of the two-component collapsible cartridge 14.

As illustrated in FIG. 5, the second portion 44 preferably is a flexible portion having a second diameter $D_4$ that is less than the diameter $D_3$ of the first rigid portion 42*a*, a first end 68 disposed in the material dispensing direction DD and a second end 70 disposed in the opposite direction (filling direction FD). The flexible portion 44 is disposed on the first end 46 of the rigid portion 42 such that the second end 70 of the flexible portion 44 is disposed to face the first end 46 of the rigid portion 42.

The flexible portion 44 is preferably formed from a material that is capable of radially expanding and longitudinally compressing upon a force applied to the first end 68 of the flexible portion 44 so as to compress the collapsible cartridge between the flexible portion 44 and the surface 22 of the support cartridge 12*a*. Thus, the flexible portion 44 can be formed any material suitable to accomplish sufficient radial expansion. Suitable materials can include, but are not limited to thermoplastic elastomer (TPE), silicone, any other elastomeric material or any suitable flexible material. In one embodiment, the flexible portion 44 is formed from a material having a durometer between about 15 and 60 on the durometer A scale. Preferably, the flexible material is formed from a material having a durometer around 25 shore A.

The flexible portion 44 includes an internal cavity 72 and at least a portion of the rigid portion 42 extends into the internal cavity 72. In other words, the flexible portion 44 has a recessed portion that defines an integral cavity 72 that is sized and configured to receive the rigid portion 42. As described above, this embodiment increases the support at the edge and guides the cartridge wall 18*a* to allow the cartridge wall 18*a* to fit the piston geometry, furthering the amount of material to be dispensed out of the two-component collapsible cartridge 14.

The overall height of the flexible portion 44 relative to the cartridge wall 18*a* length should be determined such that the flexible portion 44 makes initial contact with the end surface 22 of the head part 20 about 1-2 mm prior to the cartridge wall 18*a* reaching its compressed height. Such a compression distance will generally result in sufficient radially expansion to compress the cartridge wall 18*a*. However, the deflection of the flexible portion 44 close to the edges is reduced due to the protrusion 52 as discussed above, otherwise the tension of the cartridge wall 18*a* in this area may cause a larger than desired diameter. Such an increased diameter can trap material and air on the inside of the cartridge wall 18*a* which is undesirable.

As can be seen best from the cross sectional view of FIG. 5, the cavity 72 of the flexible portion 44 forms a recess 71 that receives the protrusion 52 of the rigid portion 42. Preferably, the protrusion 52 is received in the recess 71 in a form fit manner. Receiving the protrusion 52 in the recess 71 allows for a secure seating of the flexible portion 44 on the rigid portion 42. Furthermore, on compression of the flexible portion 44 in the dispensing direction DD, the protrusion 52 received in the recess 71 prevents that the flexible portion 44 excessively expands in the radial direction. Simultaneously, the flexible portion 44 is directed into the dispensing direction DD and exerts a force on the cartridge 14 so that more material is dispensed therefrom.

As the flexible portion 44 is compressed against the end surface 22 of the head part 20, the flexible material or the flexible portion 44 is longitudinally compressed and radially expanded. In other words, the flexible portion 44 can be flattened against the end surface 22 of the head part 20, which results in expansion of the diameter of the flexible portion 44 in the radial direction. Preferably, the flexible material of the flexible portion 44 increases in diameter by about 1-3 mm in the radial direction RD when a force of approximately 250 N is applied to the first end 68. Preferably, the diameter of the flexible portion (44, 144) increases from 2 to 15% when a force of 250 N is applied to the flexible portion (44, 144), in particular with the force being applied to the flexible portion in a direction that is at least approximately parallel to the dispensing direction DD. In one embodiment, the flexible portion 44 increases in diameter about 2 mm in the radial direction RD. This radial expansion compresses the cartridge wall 18*a* of the compressed cartridge between a radial outer surface 74 of the flexible portion 44 and the inner surface 40 of the support sleeve 12*a*, and/or the inner surface 58 the skirt 54. This structure reduces residual waste or air entrapment in the cartridge.

The first end 68 of the flexible portion 44 can have any suitable configuration. For example, the first end 68 can be generally or substantially flat or planar, it can also have an acute or curved configuration or it can have a peaked or angled configuration. The radial outer surface 74 of the flexible portion 44 can be generally parallel to the longitudinal axis L of the piston 16*a* or in can form an angle with the longitudinal axis L. That is, the diameter $D_4$ of the flexible portion 44 at the radial outer surface 74 can decrease in the dispensing direction. That is the diameter $D_4$ of the flexible portion 44 can decrease in the dispensing direction DD. Preferably the height $H_1$ of the flexible portion 44 (from the point where the skirt meets the radial outer surface 73 of the rigid member) is between about 12 and 15 mm, and preferably about 14.2 mm. Moreover, the thickness $T_1$ of the flexible portion from the radial outer surface 73 of the first rigid portion 42*a* (i.e., the radial inner surface of the flexible portion 44) to the radial outer surface 74 of the flexible portion 44 is about 1.9 mm to about 5.2 mm, and preferably about 3.8 mm. The thickness $T_2$ of the flexible portion 44 from the protrusion 52 of the second rigid portion 42*a* to the first end 58 of the flexible portion 44 is between about 6.3 mm and 3.2 mm. The thickness $T_1$ of the flexible portion 44 from the first end 46 of the rigid portion 42 to the first end 68 of the flexible portion 44 is between about 6.5 mm and 8.3 mm. Thus, the ratio of a height $H_1$ of the flexible portion 44 to the distance from the first end 46 of the rigid portion 42 to the first end 68 of the flexible portion 44 is between about 0.5 to 0.55.

The height $H_2$ of the flexible portion 44 from the end 64 of the skirt 54 to the first end 68 of the flexible portion is about 7-9 mm. However, it is noted that the dimensions are merely examples and the dimensions of the flexible portion 44 relative to the rigid portion 42, and any other dimension can be any suitable dimension.

Figures 7A, 7B, 7C, 7D, 7E:
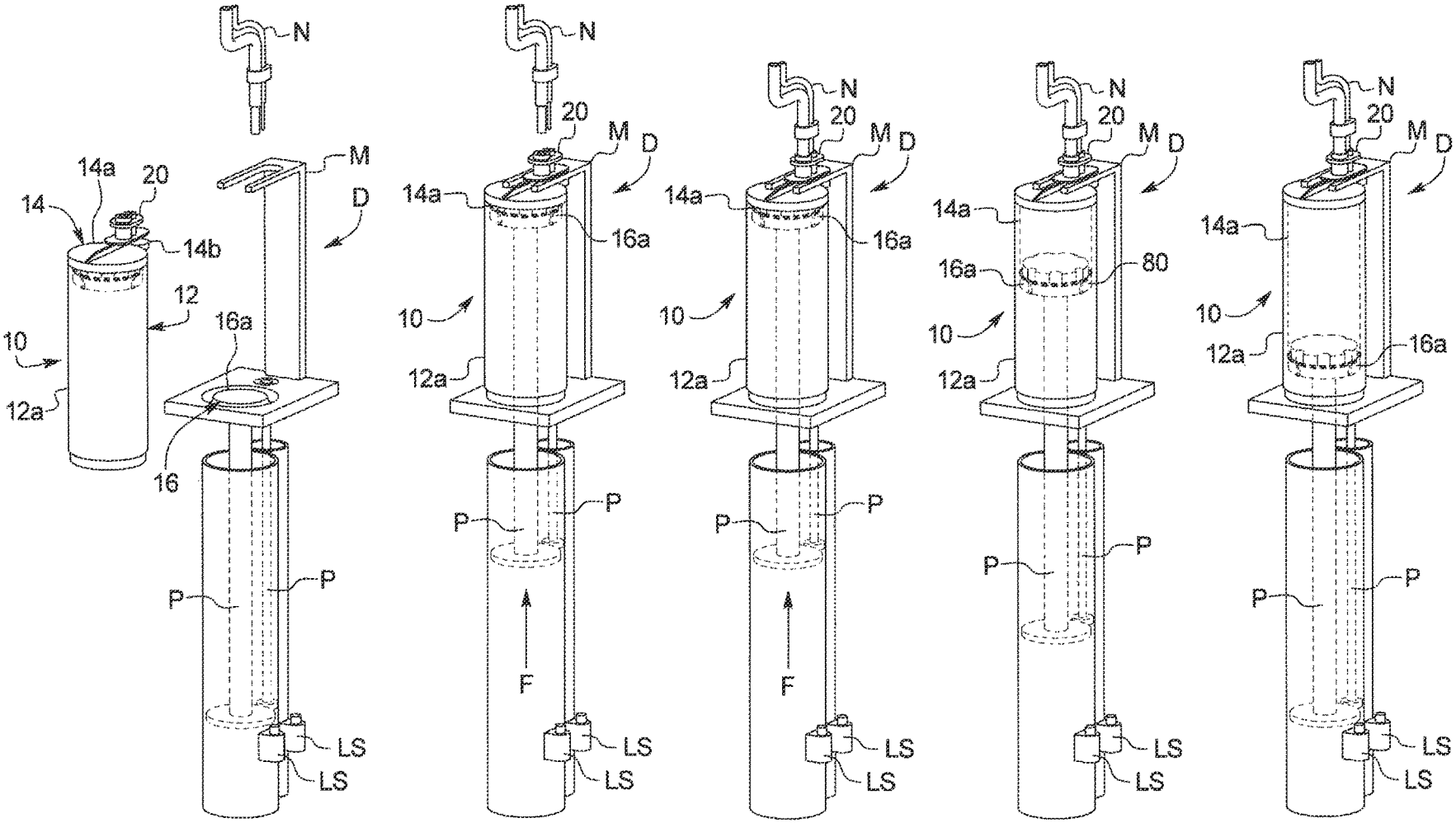
FIG. 7A-7E illustrate the filling process for the cartridge of FIG. 1.

Turning to FIGS. 7A-7E, the manner in which the two-component collapsible cartridge 14 can be filled is illustrated. In one embodiment, the two-component collapsible cartridge 14 is shipped to the distributor or user in an empty state. As shown in FIGS. 7A, the empty two-component collapsible cartridge 14 is connected to the support cartridge system 12, and then as shown in FIG. 7B, inserted into a filling device D. The filling device D includes a mounting mechanism M that is configured to attach to the head part 20 to hold the two-component collapsible cartridge 14 in a desired and proper position. Once in position, the piston system 16 is inserted into the support cartridge system 12. A shown in FIG. 7B, the piston system 16 is acted upon by force from a plurality of plungers P. The force F exerted by each plunger P can be any suitable amount (e.g., 250 N), and supplied in any manner desired, for example using compressed air, a mechanical force or any other suitable device. The piston system 16 moves in the dispensing direction toward the end surface of the head part 20. As the piston system 16 moves in this direction, each piston 16*a* in the piston system 16 enters the open end 80 of a respective cartridge wall 18*a* and 18*b*. The edge 82 of each of the cartridge wall 18*a* and 18*b* is collected in the area between the skirt 54 and the outer radial surface 74 of the flexible portion 44. The heights $H_1$ and $H_2$ can be important here, since such heights can affect the amount air or component that is dispensed or expelled from the reception chambers 14*a* and 14*b*. As the piston system 16 continues to move and collect the cartridge walls 18*a* and 18*b* air is expelled from the cartridges.

Figure 8:
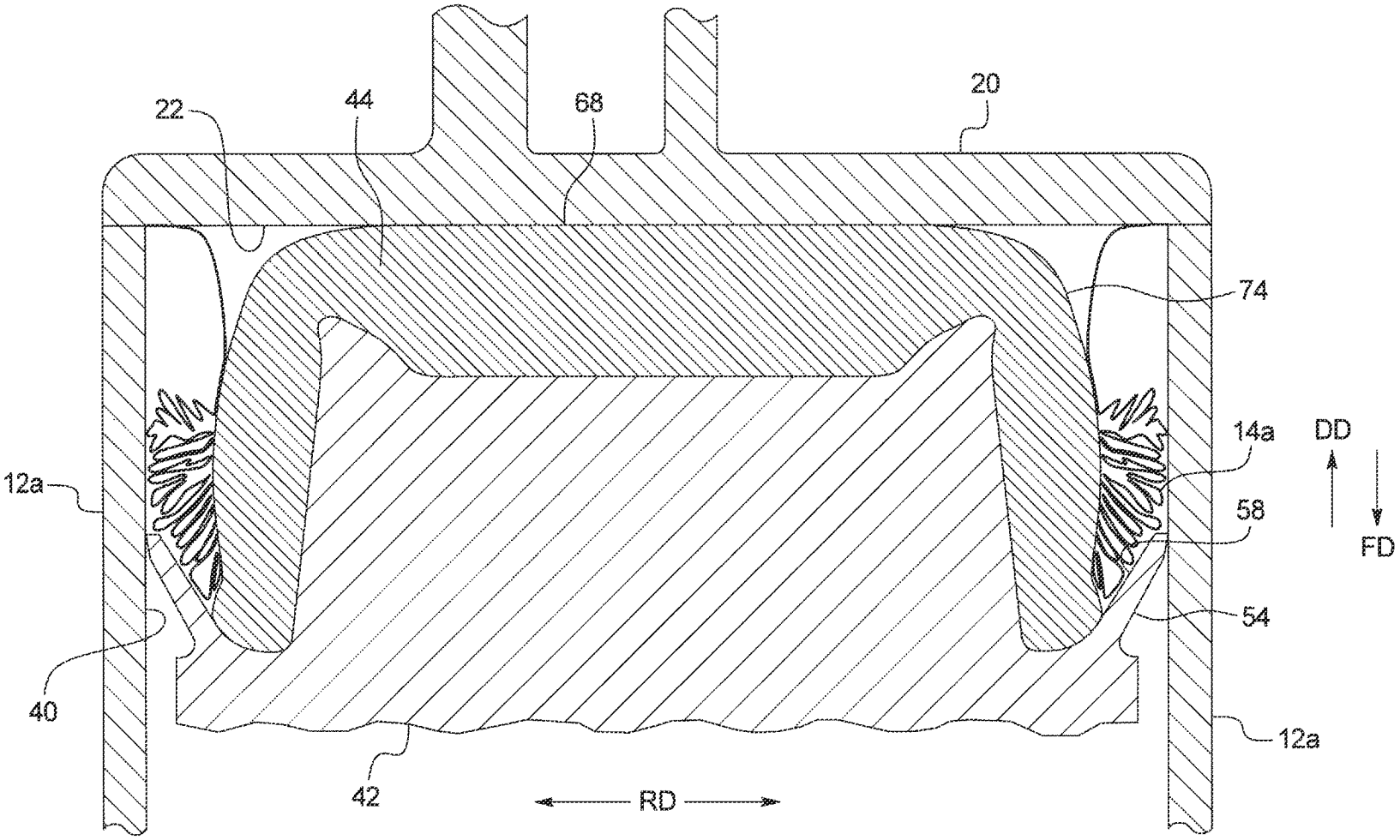
FIG. 8 illustrates a partial cross-section view of the piston and cartridge of FIG. 1 in a compressed state.

The piston system 16 continues to move in the dispensing direction DD and contacts the end surfaces 22 and 24 of the head part 20. As the piston system 16 contacts these surfaces 22 and 24, the force F is maintained in the dispensing direction DD, thereby causing the flexible portion 44 of each of the pistons 16*a* and 16*b* to be compressed in the longitudinal direction L against the surfaces 22 and 24 of the head part 20. This compression causes the flexible portion 44 of each piston to radial expand in the radial direction. As described herein the radial expansion can be about 1-3 mm (or more preferably about 2 mm) when a force of approximately 250 N is applied to the first end 68; however, it is noted that the radial expansion can be any suitable amount. As shown in FIG. 8, the radial expansion occurs in the area in which the cartridge wall 18*a* has been gathered, thus compressing the cartridge wall 18*a* between the radial outer surface 74 of the flexible portion 44 and the inner surface 40 of the support sleeve 16*a*, and/or the inner surface 58 of the skirt 54. This compression expels additional air from the collapsed cartridge.

As shown in FIG. 7C, the filing nozzle N is then attached to the head part 20 and the desired components can be injected or dispensed into the cartridge walls 18*a* and 18*b*. The force F of the filling nozzle N expands the cartridge walls 18*a* and 18*b* and pushes the piston system 16 in the filling direction FD (opposite the dispensing direction), as shown in FIG. 7D. As is understood, the force F of the plungers P can be removed, such that the filling nozzle N is only required to overcome the static force of the plungers P and expansion of the cartridge walls 18*a* and 18*b*. Once the plungers P contact the limit switches LS the filling nozzle N can be stopped. The dispensing system 10 can then be removed and closed.

To dispense, the two-component collapsible cartridge 14 is simply inserted into the dispensing device and dispensed. If desired, the dispensing can be performed using the piston system 16 described herein, which would gather the cartridge walls 18*a* and 18*b* in the area between the skirts 54*a* and the radial outer surfaces 74 and dispense the components in a similar manner to the filing described above. That is, as the piston system 16 continues to move through the support cartridge system 12, the collapsible cartridge walls

18*a* and 18*b* are collected, and the components are dispensed through the head part 20. The piston system 16 then continues to move in the dispensing direction DD and contacts the end surfaces 22 and 24 of the head part 20. As the piston system 16 contacts these surfaces, the force F (e.g., 250 N) is maintained in the dispensing direction DD, thereby causing the flexible portion 44 of each piston 16*a* and 16*b* to be compressed in the longitudinal direction L against the surfaces 22 and 24 of the head part 20. This compression causes the flexible portion 44 of each piston 16*a* and 16*b* to radial expand. As described herein the radial expansion can be about 1-3 mm (or more preferably about 2 mm) when a force of approximately 250 N is applied to the first end 68; however, it is noted that the radial expansion can be any suitable amount. The radial expansion occurs in the area in which the cartridge walls 18*a* and 18*b* have been gathered, thus compressing the cartridge walls 18*a* and 18*b* between the radial outer surface 74 of the flexible portion 44 and the inner surface 40 of the support sleeves 12*a* and 12*b*, and/or the inner surface 58 of the skirts 54. This compression expels additional component from the collapsed cartridge.

The piston structure described herein improves the amount of component that can be dispensed by both removing excess air during the filling procedure and expelling additional component during the dispensing procedure. Such a system reduces waste of components, thereby reducing cost and environmental impact.

Figure 9:
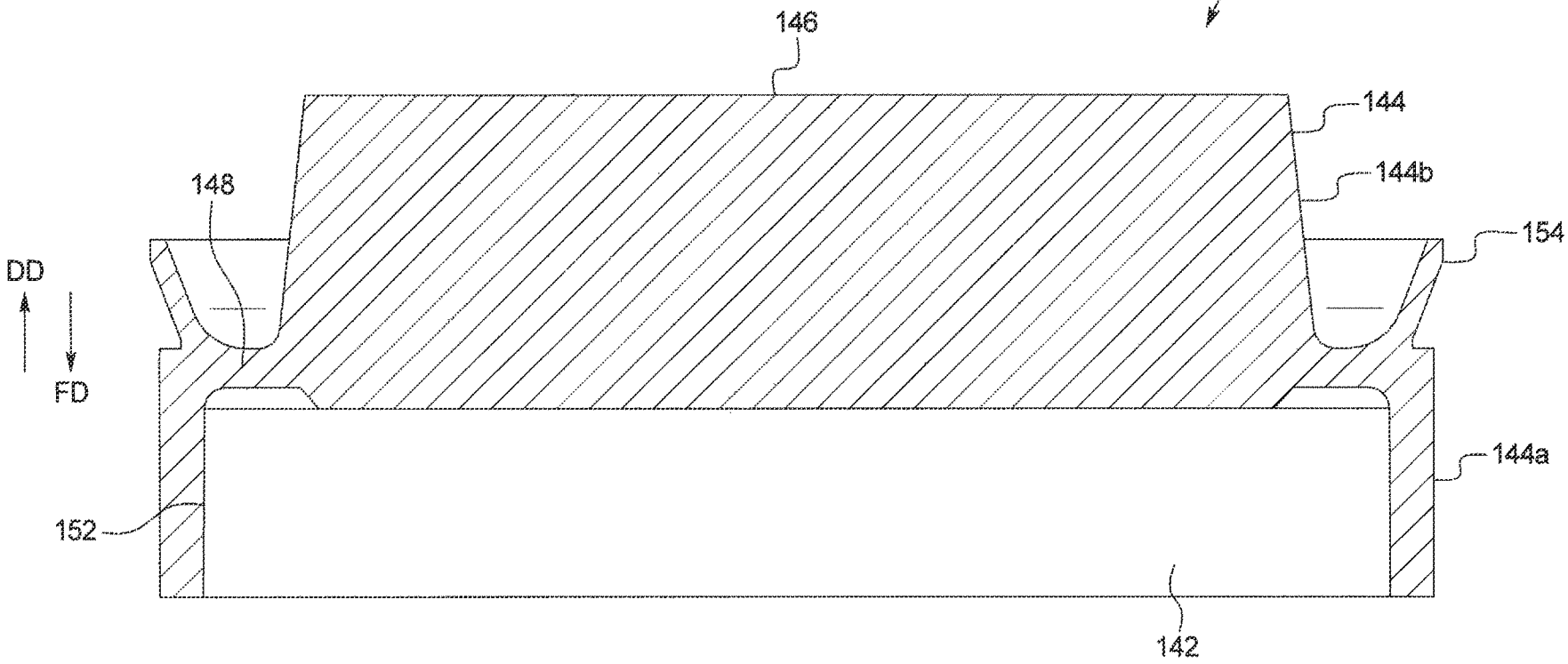
FIG. 9 illustrates a partial cross section view of a second embodiment of a piston.

FIG. 9 is a partial cross-sectional view of a second embodiment or a piston 116. In this embodiment, the skirt 154 is attached to the flexible portion 144. That is, the flexible portion 144 includes a first portion 144*a* and second portion 144*b*. The first portion 144*a* is tubular and is connected to the rigid portion 142 at an outer radial 152 surface thereof. The second portion 144*b* generally comprises the compressible/flexible portion 146 that operates in the same manner as the flexible portion 144 described herein. The skirt 154, in this embodiment, is attached to a transverse portion 148 between the first and second portions 144*a* and 144*b* and extends in the dispensing direction DD. Here the second portion 144*b* preferably has a height between about 9.5 mm and 12.9 mm. The piston 116 operates in the same manner as described herein for the pistons 16*a* and 16*b* of the first embodiment.

Although the rigid portion 142 as shown in FIG. 9 has no protrusion 52 like the rigid portion 42 shown in FIGS. 5 and 6, one could also envisage that the rigid portion 142 may comprise a protrusion 52 similar to that of the rigid portion 42, with such a protrusion 52 being received in the cavity 71 of the flexible portion 144.

It is noted that any description of one piston described herein can be applied to multiple pistons.

The dispensing device, into which the present dispensing system is inserted to affect dispensing and the filling device are conventional components that are well known in the art. Since the dispensing device and the filling device are well known in the art, these structures will not be discussed or illustrated in detail herein. Rather, it will be apparent to those skilled in the art from this disclosure that the components can be any type of structure and/or include any programming that can be used to carry out the present invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," or "portion," when used in the singular can have the dual meaning of a single part or a plurality of parts. Also as used herein to describe the above embodiment(s), the following directional terms refer to those directions of a system equipped with the piston for a collapsible cartridge. Accordingly, these terms, as utilized to describe the present invention should be interpreted relative to a system equipped with the piston for a collapsible cartridge.

The term "configured" as used herein to describe a component, section or part of a device includes hardware and/or software that is constructed and/or programmed to carry out the desired function.

The terms of degree such as "substantially", "approximately" and "about" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A piston for a collapsible cartridge for dispensing a material, the piston comprising:

a rigid portion having a first diameter, a first end and a second end, the first end configured to be disposed in a material dispensing direction, the rigid portion further comprising a skirt extending from a radial outer surface of the rigid portion in the material dispensing direction; and a flexible portion having a second diameter less than the first diameter, a first end disposed in the material dispensing direction and a second end disposed in an opposite direction, the first end of the flexible portion extending entirely beyond an end of the skirt in the material dispensing direction, and the flexible portion being disposed on the first end of the rigid portion such that the second end of the flexible portion is disposed to face the first end of the rigid portion, and the flexible portion configured to radially expand and longitudinally compress upon a force applied to the first end of the flexible portion so as to compress the collapsible cartridge between the flexible portion and an interior surface of a support cartridge.

2. A piston for a collapsible cartridge for dispensing a material, the piston comprising:

a rigid portion having a first diameter, a first end and a second end, the first end configured to be disposed in a material dispensing direction;

a flexible portion having a second diameter less than the first diameter, a first end disposed in the material dispensing direction and a second end disposed in an opposite direction, the flexible portion being disposed on the first end of the rigid portion such that the second end of the flexible portion is disposed to face the first end of the rigid portion, and the flexible portion configured to radially expand and longitudinally compress upon a force applied to the first end of the flexible portion so as to compress the collapsible cartridge between the flexible portion and an interior surface of a support cartridge; and a skirt configured to gather the collapsible cartridge as the collapsible cartridge is compressed, the skirt is disposed on one of the flexible portion and the rigid portion and including a longitudinally extending tab on an outer surface that extends in a direction parallel to the material dispensing direction.

3. The piston according to claim 1, further comprising the skirt configured to gather the cartridge as the cartridge is compressed.

4. The piston according to claim 2, wherein the skirt is disposed on one of the flexible portion and the rigid portion.

5. The piston according to claim 3, wherein the skirt includes a tab on an outer surface.

6. The piston according to claim 2, wherein at least one hole is disposed in the skirt.

7. The piston according to claim 1, wherein the first end of the flexible portion is planar, curved, peaked or angled.

8. The piston according to claim 1, wherein the flexible portion includes a radial outer surface, the radial outer surface having the second diameter that decreases in the material dispensing direction.

9. The piston according to claim 1, wherein the flexible portion is formed from a material having a durometer between 15 and 60.

10. The piston according to claim 1, wherein the flexible portion is formed from at least one of a flexible material, an elastomeric material, a thermoplastic elastomer or silicone.

11. The piston according to claim 9, wherein a diameter of the flexible material is configured to radially expand between 1 mm and 3 mm when the force is approximately 250 N.

12. The piston according to claim 1, wherein a diameter of the flexible portion increases from 2 to 15% when the force applied to the flexible portion is 250 N.

13. The piston according to claim 1, wherein the flexible portion includes an internal cavity and at least a portion of the rigid portion extends into the internal cavity.

14. The piston according to claim 1, wherein the first end of the rigid portion includes a protrusion at the circumferential edge thereof.

15. The piston according to claim 14, wherein a cavity of the flexible portion forms a recess that receives the protrusion of the rigid portion.

16. The piston according to claim 1, wherein the flexible portion includes an internal cavity and at least a portion of the rigid portion extends into the internal cavity, such that the ratio of a height of the flexible portion to the distance from the first end of the rigid portion to the first end of the flexible portion is between 0.5 to 0.55.

17. A dispensing system, comprising:

a cartridge having a head part and a cartridge wall which define a reception chamber configured to retain a medium to be dispensed, the head part including a surface and an outlet in the surface, the outlet configured to enable the material to be dispensed therethrough, the cartridge wall configured to be collapsible; and the piston according to claim 1 configured to collapse the cartridge and dispense the medium, the flexible portion configured to radially expand upon the force being applied to the piston in the material dispensing direction such that the first end of the flexible portion contacts the surface of the head part.

18. A dispensing system, comprising:

a cartridge having a head part and a cartridge wall which define a reception chamber configured to retain a medium to be dispensed, the head part including a surface and an outlet in the surface, the outlet configured to enable the material to be dispensed therethrough, the cartridge wall configured to be collapsible; and the piston according to claim 1 configured to collapse the cartridge and dispense the medium, the flexible portion configured to radially expand between 1 mm and 3 mm upon the force being applied to the piston in the material dispensing direction such that the first end of the flexible portion contacts the surface of the head part.

19. The dispensing system according to claim 17, wherein the second diameter of the flexible portion decreases in the material dispensing direction.

20. The dispensing system according to claim 17, wherein the flexible portion is formed from a material having a durometer between 15 and 60, such that the flexible material is configured to radially expand between 1 mm and 3 mm upon the contact with the surface of the head part when the force is approximately 250 N.

21. A method of filling a material into a cartridge, the method comprising: collapsing the cartridge with the piston according to claim 1, the piston having the rigid portion and the flexible portion, the flexible portion being disposed at the dispensing end of the piston; applying a force to the piston such that the flexible portion of the piston contacts a surface of a head part of the cartridge, causing a diameter of the flexible portion to radially increase; compressing the cartridge between a radial surface of the flexible portion and the interior surface of the support cartridge; and adding the material through an opening in the head part, causing the piston to move in a direction away from the head part.

22. The method of claim 21, wherein the collapsing the cartridge includes gathering the cartridge in the skirt disposed on the piston.

23. The method of claim 21, wherein the applying the force to the piston includes applying a force of approximately 250 N, causing the diameter of the flexible portion to increase between about 1 mm to 3 mm to expel air from the cartridge.

24. A method of dispensing a material from a cartridge comprising:

providing the dispensing system according to claim 17, and applying a second force to the piston to dispense the material through the opening in the head part.

25. The method of claim 24, wherein the applying the second force to the piston causes the cartridge to be gathered in a skirt disposed on the piston.

26. The method of claim 24, wherein the applying the second force to the piston causes the flexible portion to contact the surface of the head part and the diameter of the flexible portion to radially increase and a radial circumferentially surface of the flexible portion to contact a portion of the cartridge to dispense the material through the opening in the head part.

* * * * *